US011131136B2

(12) United States Patent
Kaounas

(10) Patent No.: US 11,131,136 B2
(45) Date of Patent: Sep. 28, 2021

(54) EMERGENCY RELEASE DEVICE FOR MANUALLY OPENING AND CLOSING A FOUR FOLD POWER DOOR SYSTEM

(71) Applicant: John Kaounas, Canton, MI (US)

(72) Inventor: John Kaounas, Canton, MI (US)

( * ) Notice: Subject to any disclaimer, the term of this patent is extended or adjusted under 35 U.S.C. 154(b) by 386 days.

(21) Appl. No.: 16/217,141

(22) Filed: Dec. 12, 2018

(65) Prior Publication Data

US 2019/0211606 A1 Jul. 11, 2019

Related U.S. Application Data

(60) Provisional application No. 62/613,879, filed on Jan. 5, 2018.

(51) Int. Cl.

| | |
|---|---|
| ***E05F 17/00*** | (2006.01) |
| ***E05F 15/40*** | (2015.01) |
| ***E06B 3/48*** | (2006.01) |
| ***E05D 15/26*** | (2006.01) |

(52) U.S. Cl.

CPC ..... *E05F 17/004* (2013.01); *E05D 15/264* (2013.01); *E05F 15/40* (2015.01); *E06B 3/481* (2013.01); *E05F 2017/005* (2013.01); *E05Y 2800/11* (2013.01); *E05Y 2900/132* (2013.01)

(58) Field of Classification Search

CPC ..... E05F 17/004; E05D 15/264; E06B 3/481
USPC ..... 49/141
See application file for complete search history.

(56) References Cited

U.S. PATENT DOCUMENTS

| | | | | | |
|---|---|---|---|---|---|
| 1,373,567 | A * | 4/1921 | Overlien | E05F 17/004 | 49/109 |
| 1,479,399 | A * | 1/1924 | Olson | E05F 17/004 | 49/113 |
| 1,570,641 | A * | 1/1926 | Perkins | E05F 17/004 | 49/103 |
| 1,965,841 | A * | 7/1934 | Kraft | E05F 17/004 | 49/26 |
| 1,975,766 | A * | 10/1934 | Burgett | E05F 17/004 | 49/101 |
| 2,078,308 | A * | 4/1937 | Behle | E05F 17/004 | 49/109 |

(Continued)

FOREIGN PATENT DOCUMENTS

| | | |
|---|---|---|
| EP | 778387 A1 | 6/1997 |
| GB | 2428734 A | 2/2007 |

*Primary Examiner* — Gregory J Strimbu
(74) *Attorney, Agent, or Firm* — Dinsmore & Shohl LLP

(57) ABSTRACT

A power door system for actuating door panels between closed and opened positions. An operator arm telescopically supports a push rod. A housing is secured to the operator arm. A spring pin extends through apertures in the arm and the push rod. A release cable extends from the housing and is movable to retract the pin, permitting inter-telescoping motion of the push rod relative the operator arm, in turn permitting manual displacement of the doors. A compression spring supported within the housing influences the pin into engagement with the operator arm and push rod. A locking pin and guide is incorporated into a cable mounting guard below the spring pin, the locking pin displacing with the spring pin to a retracted position in response to actuation of the release cable, a successive actuation of the release cable releasing the spring pin and lock pin to reengage the apertures in the arm and the push rod.

3 Claims, 12 Drawing Sheets

(56) References Cited

U.S. PATENT DOCUMENTS

| | | | | |
|---|---|---|---|---|
| 2,221,039 | A * | 11/1940 | Babcock | E05F 15/622 49/139 |
| 5,712,546 | A | 1/1998 | Holthouse et al. | |
| 6,932,393 | B2 | 8/2005 | Erices | |
| 7,059,084 | B2 * | 6/2006 | Hoskeer | E05F 17/004 49/118 |
| 8,341,889 | B2 | 1/2013 | Faulkner et al. | |
| 9,194,163 | B2 | 11/2015 | Margheritti et al. | |
| 9,610,830 | B2 * | 4/2017 | Orton | E05F 15/676 |
| 9,624,710 | B2 | 4/2017 | Bowman et al. | |
| 2010/0123322 | A1 | 5/2010 | Gonzalez | |
| 2010/0315229 | A1 | 12/2010 | Shin | |
| 2014/0259939 | A1 | 9/2014 | Collinson et al. | |

* cited by examiner

EMERGENCY RELEASE DEVICE FOR MANUALLY OPENING AND CLOSING A FOUR FOLD POWER DOOR SYSTEM

CROSS REFERENCE TO RELATED APPLICATIONS

The present application claims priority from U.S. Ser. No. 62/613,879 filed Jan. 5, 2018, the contents of which are incorporated by reference.

FIELD OF THE INVENTION

The present invention relates generally to four fold power door systems. More specifically, the present invention discloses an emergency release device, such as which can be actuated by an operator at ground level, for disengaging a push rod to operator arm linkage connection associated with an overhead location of the door system in order to disengage a spring biased and cable actuated locking pin to retract from the push rod to permit the door assembly to be fully displaced between closed and opened positions (such as following a loss of power or other malfunction of the power door system). The manual bypass release is particularly suited for use by governmental, commercial and municipality installations, such as fire stations or other emergency/rescue services, and in order to readily operate the four fold door systems in the every of emergency or power failure such occurring independently of the power winding mechanism which becomes deactivated as a result of loss of power.

BACKGROUND OF THE INVENTION

The prior art is documented with examples of power door systems. A first example of this is depicted in the door operating system of Bowman, U.S. Pat. No. 9,624,710, and which illustrates one known arrangement of a four fold power door assembly including each of a motive source, linkage assembly and a plurality of pivotal doors. Not shown in the prior art is a mechanism for enabling manual release of the door assembly for opening/reclosing, such as in response to a loss of power.

SUMMARY OF THE PRESENT INVENTION

The present invention discloses a manual release assembly for use with a power door system including an overhead linkage for actuating a pair of pivotally associated door panels between closed and opened positions. The linkage includes an operator arm telescopically supporting a push rod, with the release assembly including a housing secured to the operator arm. A spring biased pin extends through aligning apertures in the operator arm and the telescopically secured push rod. A release cable extends from the housing and, in response to displacement by an operator, causing the pin to retract, permitting inter-telescoping motion of the push rod relative the operator arm, this in turn permitting manual displacement of the door panels between open and closed positions, such as in the event of a power loss to motor drive assembly which controls normal powered actuation of the door panels through the overhead linkages.

Other features include a compression spring supported within the housing and influencing the spring pin into engagement with the operator arm and push rod. A locking pin and locking pin guide are incorporated into a cable mounting guard positioned below the spring pin, the locking pin displacing with the spring pin and preventing return displacement of the spring pin in response to a single pull retraction of the spring pin.

Yet additional features include a spring retainer for supporting the spring pin relative to the compression spring. A manual release handle displaces the release cable, with an arrangement of pulleys routing the cable to the housing.

A related variant of the invention teaches a first bracket fixed to the operator arm, a second elongated member being pivotally mounted, about a pinned location, to the first bracket. A first inner end of the elongated pivot member, in a normally engaged position, is seated within a notch configuration within the push rod proximate to a telescoping interface established between the push rod and operator arm.

A coil spring connects at a first end to an outer corner location of the pivotal member, the spring connected at a second end to a rear exposed edge location of the fixed bracket. In this manner, the coil spring exerts a first directed force on the pivotal member to normally bias the seating inner edge of the pivot member into contact with the notch defined in the push rod, thereby preventing manual or bypass telescoping of the push rod relative to the operator arm.

A variation of the release cable extends from a handle release locations at ground level, to an edge location associated with the pivotal member. In response to displacement by an operator, the cable exerts a second opposite directed force causing the engagement inner end of the pivotal member to unseat from the notch, thereby permitting bypass telescoping of the push rod relative to the operator arm, permitting manual displacement of the door panels.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to the attached figures, the present invention discloses an emergency release device such as for use with a four-fold power door system and in order to permit the doors to be fully actuated between closed and opened positions in the absence of power to the system. As will be further described, the system incorporates a bypass mechanism integrated into the linkage associated with each pair of folding doors, such including a compression spring loaded pin which is normally engaged through an operator arm and inner telescoping push rod, forming a connecting portion of the four fold door.

As will be further described, a release cable extends to a ground level accessible handle and, upon being pulled by a user (such as following a loss of power input from the overhead power operating system to each linkage controlled pair of folding doors) the locking pin is withdrawn in counter-biasing fashion to compress the spring and to unseat from the push rod. In this manner, the manual release allows for manual pivoting of the doors between fully closed and fully opened positions, resulting from telescoping of the push rod to operator arm interface in order to bypass the (locked/fixed) central overhead drive mechanism, such further including an electric motor operating a gear/chain to pivoting control arm drive for concurrently actuating each pair of side disposed doors, via an operative linkage including the push rod to operator arm interface in a normally locked arrangement.

Figure 1A:
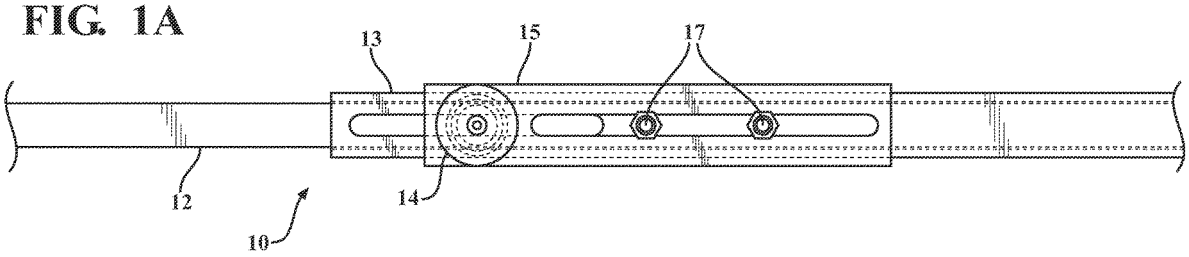
FIGS. 1A and 1B are respective front and top plan views of a spring biased locking pin in engagement with an operator arm component of the four fold power door system according to a normal operation mode of the two way manual release assembly of the present invention.
Figure 1B:
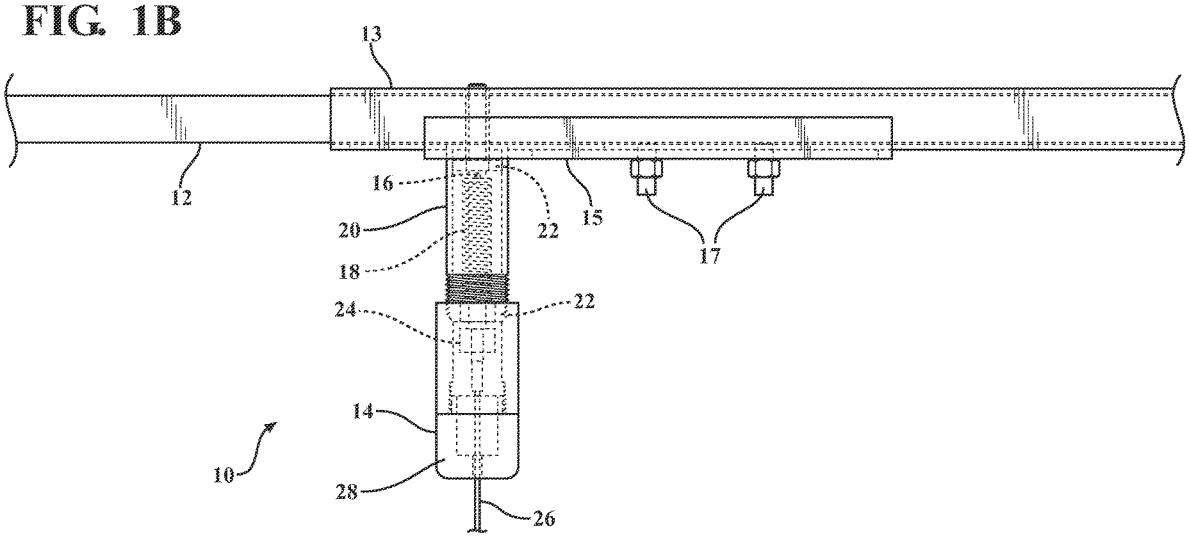

Referencing FIGS. 1A and 1B, a pair of side and top plan views are shown, at 10, of an emergency release mechanism integrated into the four fold power door system, such typically including an overhead power and drive unit which includes a push rod to operator arm linkage, see push rod 12 which is telescopingly received within an end of an outer operator arm 13, and for controlling actuation of the linkage in response to disengagement, such as following a loss of power (usually resulting from an electrical power outage) to the door system. The emergency release includes a subassembly housing 14 which is mounted to the linkage interface, such as via a mounting plate 15 secured to the operator arm 13 via a pair of studs 17, and so as to be located between the push rod and operator arm, and which includes a spring biased locking pin 16 in an engaged and locked position of the four fold power door system according to a normal operation mode.

The pin 16 is maintained in a locking engagement with the push rod to operator arm interface via a compression spring 18 influencing the pin 16. Further shown is a spring retainer 20 for seating the pin between the extended and retracted positions and a locking pin guide 22 (forming a portion of a cable mounting guard positioned below the spring pin and spring retainer) also provides directional control between the positions.

An axially displaceable locking pin 24 is integrated into an upper end of the housing 14 below the spring pin and locking pin guide. A manual release cable 26 (such as a wire rope) is provided and which extends between an operator accessible ground proximate location (not shown and such as which can also include a handle or the like).

An upper end of the release cable 26 engages the housing subassembly, via an ultra high molecular weight (U.H.M.W.) cable guide 28 and so that, as will be further described, pulling on the release cable 26 results in the locking pin 24 and slaved/counter biased spring pin 16, being retracted downwardly so that the spring pin unseats from the aligning aperture locations configured between the telescoping push rod to operator arm interface.

Figure 2A:
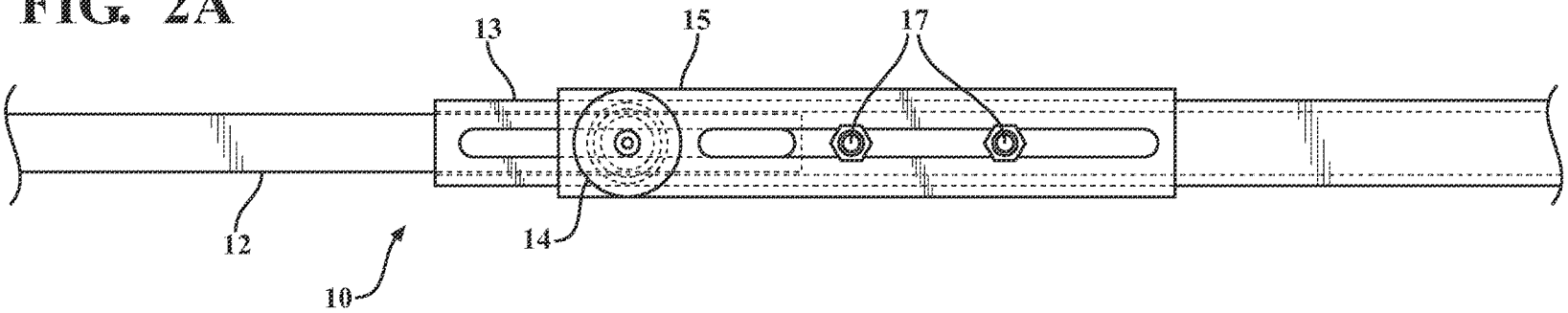
FIGS. 2A and 2B are succeeding front and top plan view illustrations of a door closed position with loss of power, resulting in retraction of the locking pin against its spring bias.
Figure 2B:
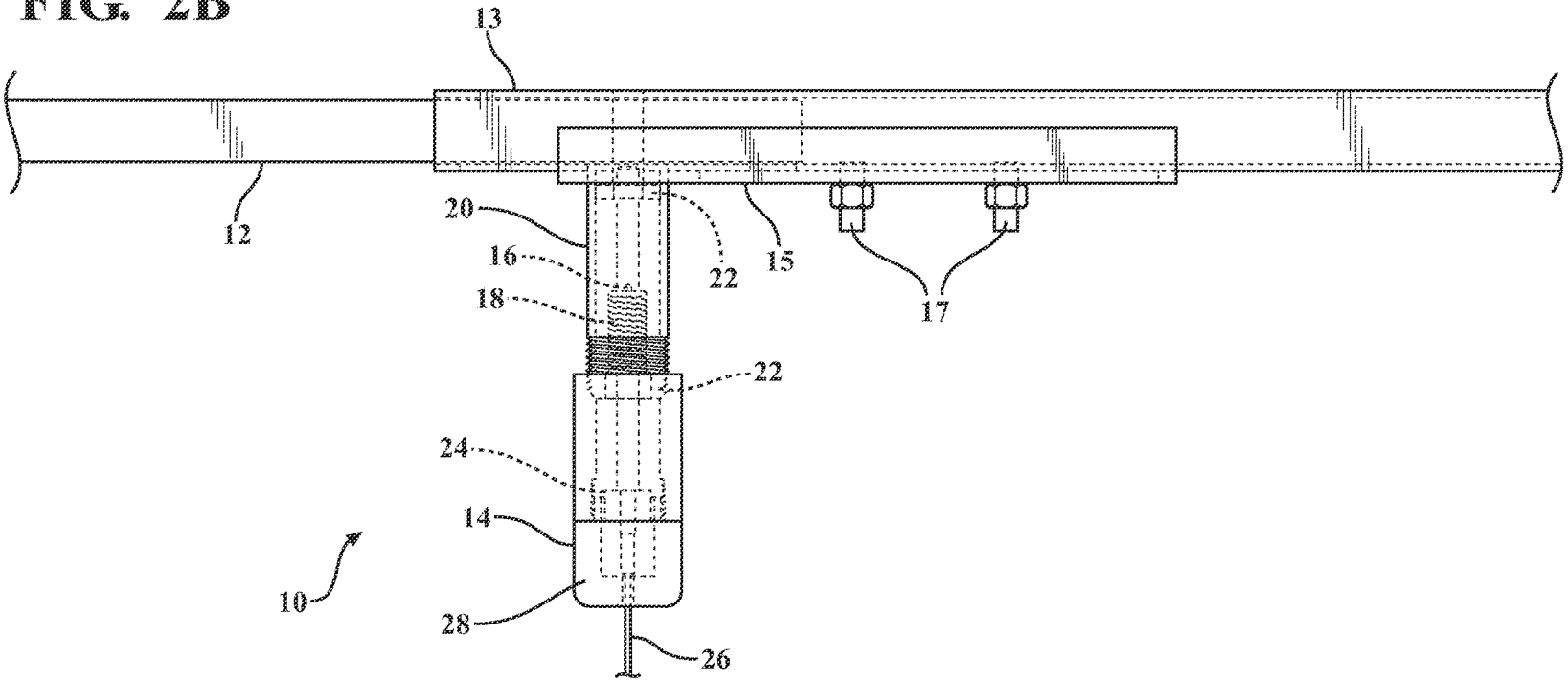

As shown in FIGS. 2A and 2B, and following such as a loss of power to the system, a succeeding illustration is shown of a door closed position with retraction of the spring pin 16 and associated locking pin 24 against the bias of the compression spring 18 resulting from pulling on the cable 26 by the operator. At this point, the spring pin 16 is retracted out of the aligning aperture locations established between the inner push rod 12 and outer telescoping operator arm 13.

Figure 3A:
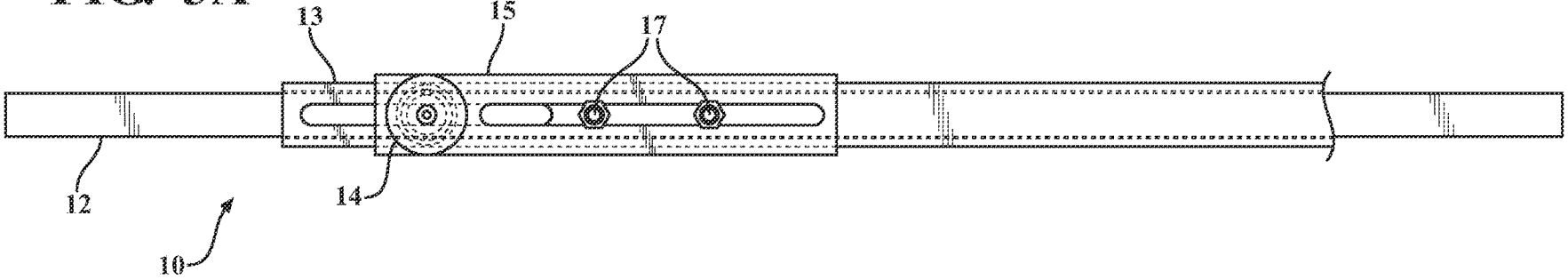
FIGS. 3A and 3B are further succeeding door open illustration with loss of power in which the doors can be pivoted between opened and closed positions.
Figure 3B:
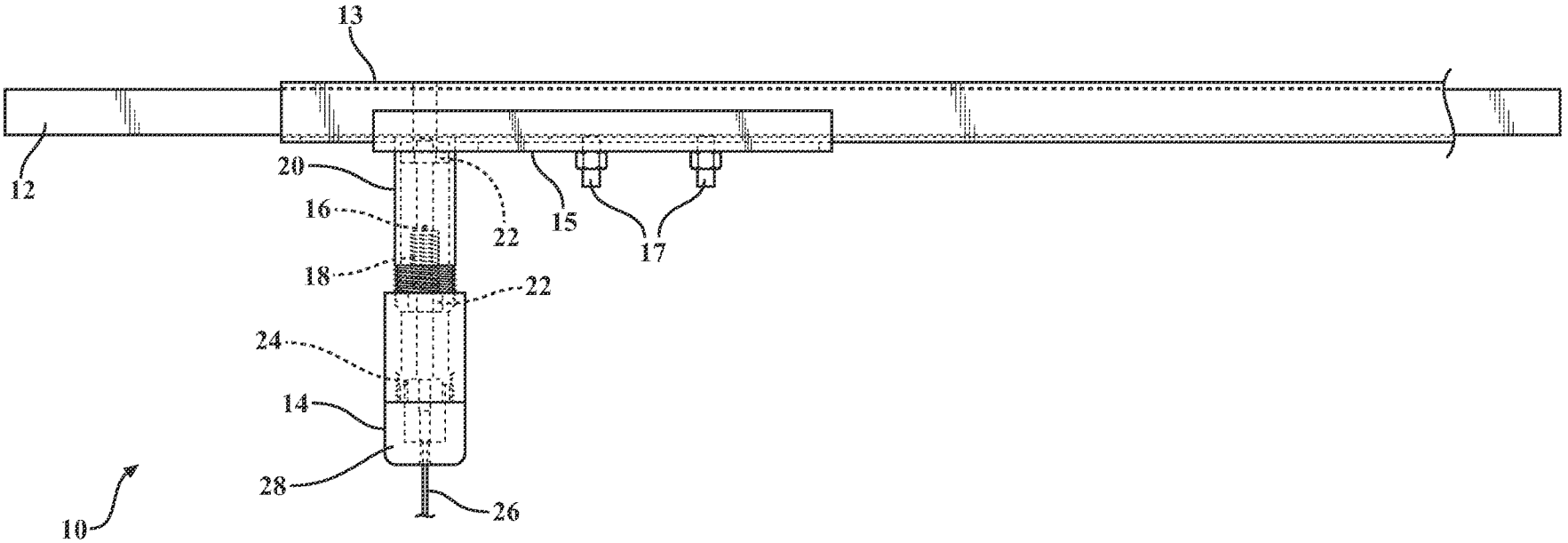

FIGS. 3A and 3B collectively illustrate a further door open illustration, with loss of power, in which the four fold doors associated with the system can be pivoted fully between opened and closed positions. The lock pin structure can provide retention of the spring pin 16 in the fully retracted position of FIGS. 2B and 3B (such following the initial pulling action on the cable), with a successive cable pull releasing the spring loaded pin to re-insert in the manner illustrated in FIG. 1 in order to re-lock in the engaged/closed position of FIG. 1. In this manner, the emergency release can be manipulated in order to fully open and close the door system in the event of loss of power.

Figure 4A:
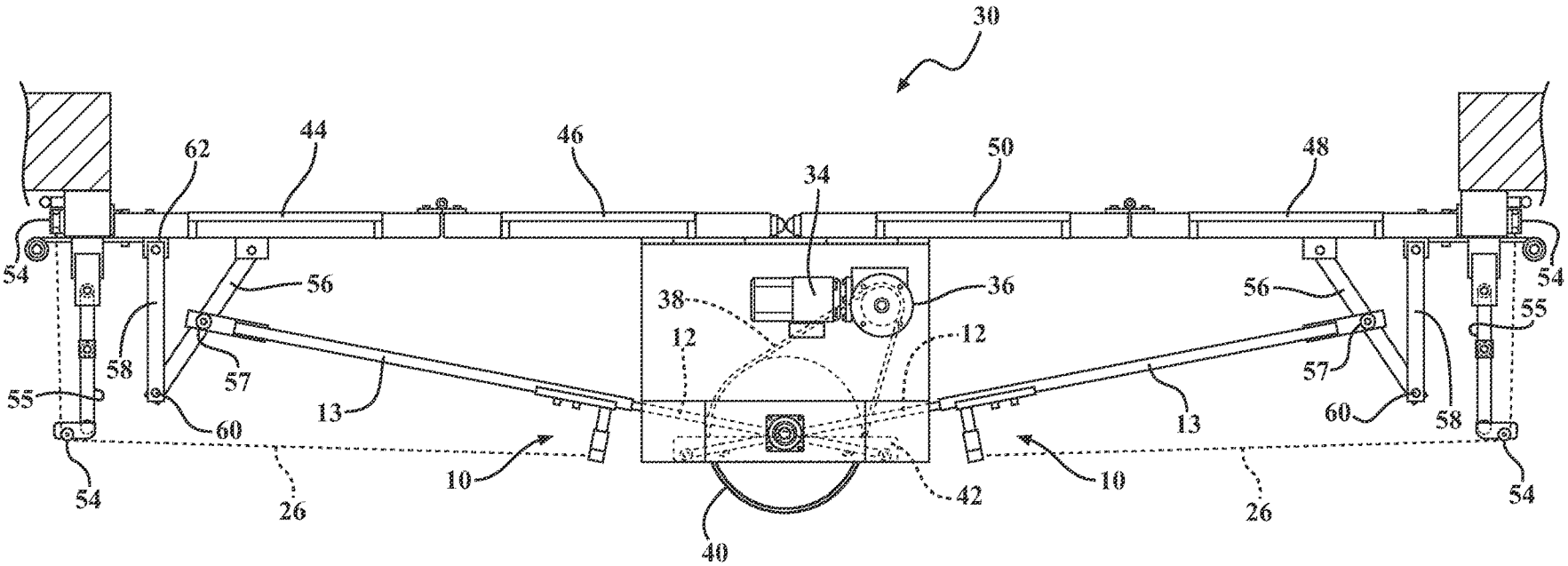
FIGS. 4A and 4B respectively depict top and upper front plan views of a four fold door assembly in a normal (powered) operation mode with the doors closed, a linkage operating each pair of pivoting doors and integrating an emergency release mechanism.
Figure 4B:
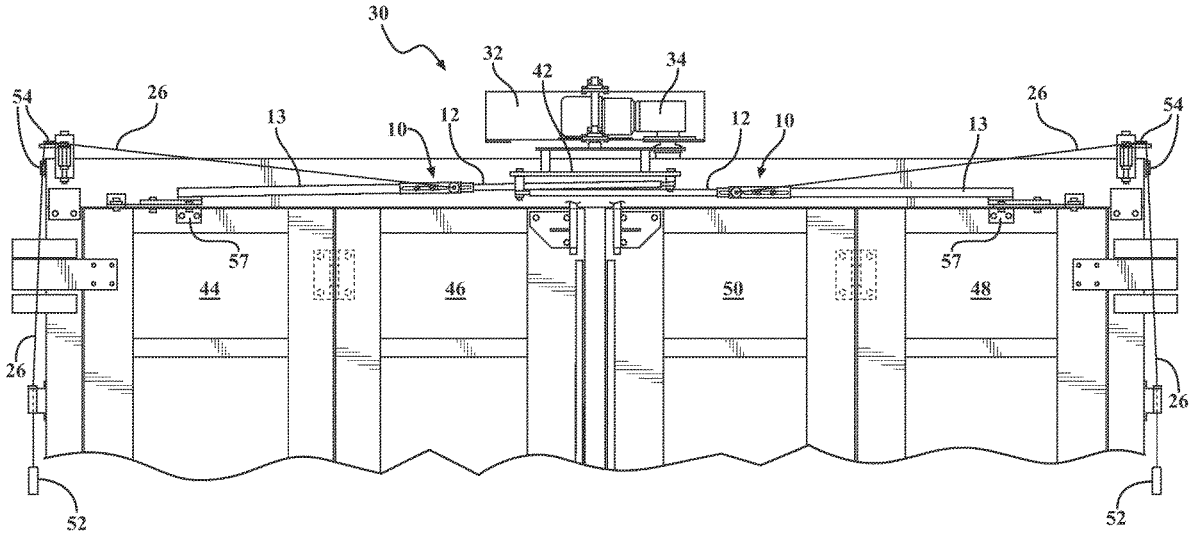

FIGS. 4A and 4B respectively depict top and upper front plan views of a four fold door assembly, generally at 30, in a normal (powered) operation mode, a linkage operating each pair of pivoting doors and integrating an emergency release mechanism 10. As described previously, the emergency release linkages operate to provide a telescoping bypass opening/closing of the doors in the event of deactivation (loss of power, etc.,) to the power unit operating the doors.

As further shown, the overhead operator assembly includes a housing 32 which supports an electric motor 34 which, upon being activated, drives a bevel or other output drive gear 36. A chain 38 (or other output) extends between the motor output gear 36 and a further toothed gear 40. A rotatable or other takeoff component of the further gear 40 in turn supports a control arm 42, opposite ends of which receive opposing, inward and overlapping ends of a pair of the push rods 12 associated with each respective linkage mechanisms so that, during normal powered/winding operation, the pusher rod to drive arm linkages are fixed in length to enable the overhead operator assembly to pivot the pairs of doors (see at 44/46 and 48/50) between the opened and closed positions.

The emergency release mechanism is again shown and depicts a handle 52 (one per side for releasing a given pair 44/46 and 48/50 of doors as best shown in FIG. 4B). A manual release cable or rope (see also 26 in FIGS. 1-3) is depicted at 26 and is routed, via an arrangement of pulleys 54 (either upper corner as additionally depicted in FIG. 4B), to each manual release assembly 10, these being mounted in paired fashion to horizontally extending overhead supports 55. As further shown, each of the manual release mechanisms are mounted in a horizontal disposed fashion to the operating linkages (so as not to protrude downwardly into the opening space), the connecting ends of the release cables 26 being routed (see as shown in phantom) via the pulleys to connect to the cable guide portions of each release mechanism in a manner which translates a downward pulling action on each handle 52 to a linear retraction force exerted by the cable on the release mechanism 10 in order to retract the spring pin 16 (along with locking pin to restrain the pin 16 in the retracted position to permit manual and inter-bypass telescoping of the push rod 12 relative to the operator arm 13).

As further shown in the overhead view of FIG. 4A, the drive/operator arms 13 are each pivotally mounted (at 57) to an intermediate location of a linkage arm 56, such in turn pivotally connected to a selected outermost door (44 or 48) associated with the respective pairs of pivotal doors. A further linkage arm 58 pivotally interconnects an extending end of each first linkage arm 56 (at end 60), with an opposite pivotal end 62 mounting to a side frame location of the door assembly. In this manner, the respective linkages (in response to either normal powered winding or manually bypass actuation) cause the respective pairs or doors to pivot/fold between the open and closed positions. While disclosing the necessary structure for explaining the functionality of the four fold door system, it is understood that additional structure or components necessary for operating the assembly are provided which are not articulated for purposes of the current disclosure.

Figure 5A:
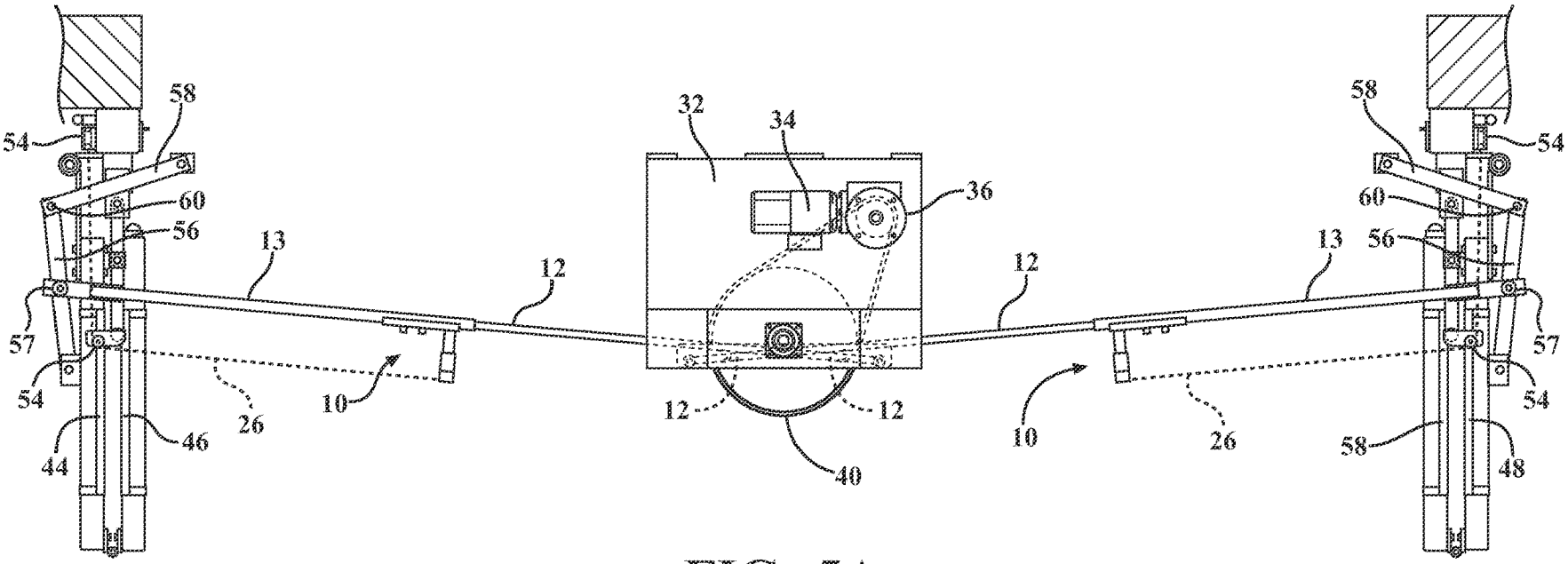
FIGS. 5A and 5B are top and upper front plan views of the four fold power doors with power out and the emergency devices actuated.
Figure 5B:
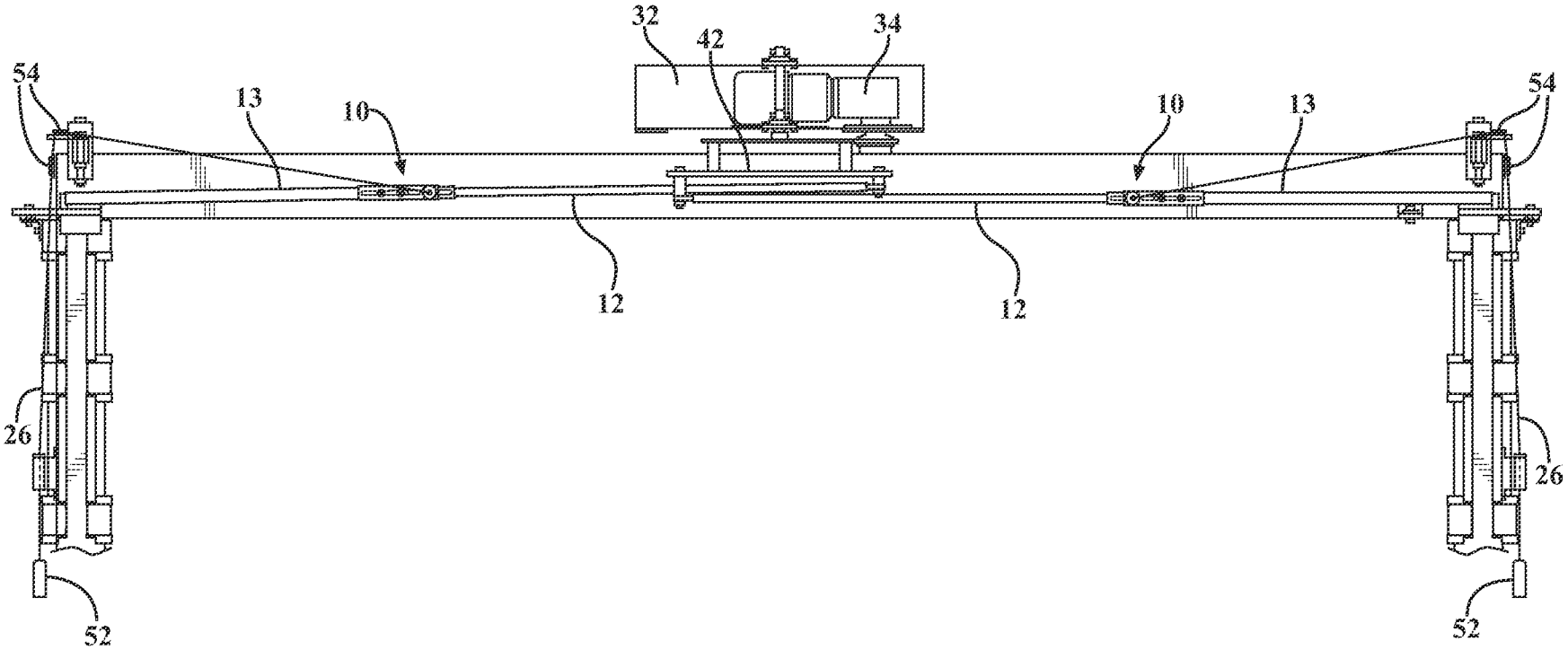

FIGS. 5A and 5B are top and upper front plan views of the four fold power door with power out and the emergency devices actuated for permitting manual opening of the pairs of foldable doors between fully opened and closed positions. Reference is again made to the element descriptions of FIGS. 4A-4B.

Figure 6A:
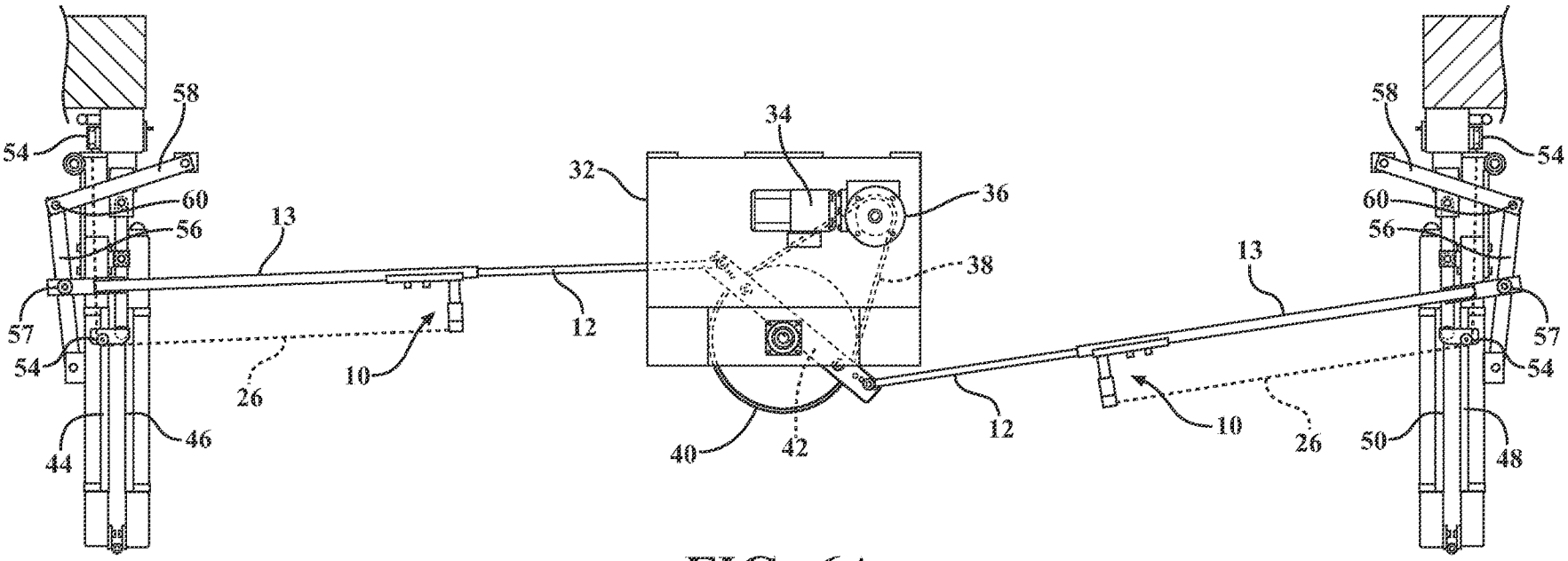
FIGS. 6A and 6B illustrate top and upper front plan views of the four fold power doors in an open normal operation with the emergency release mechanisms locked.
Figure 6B:
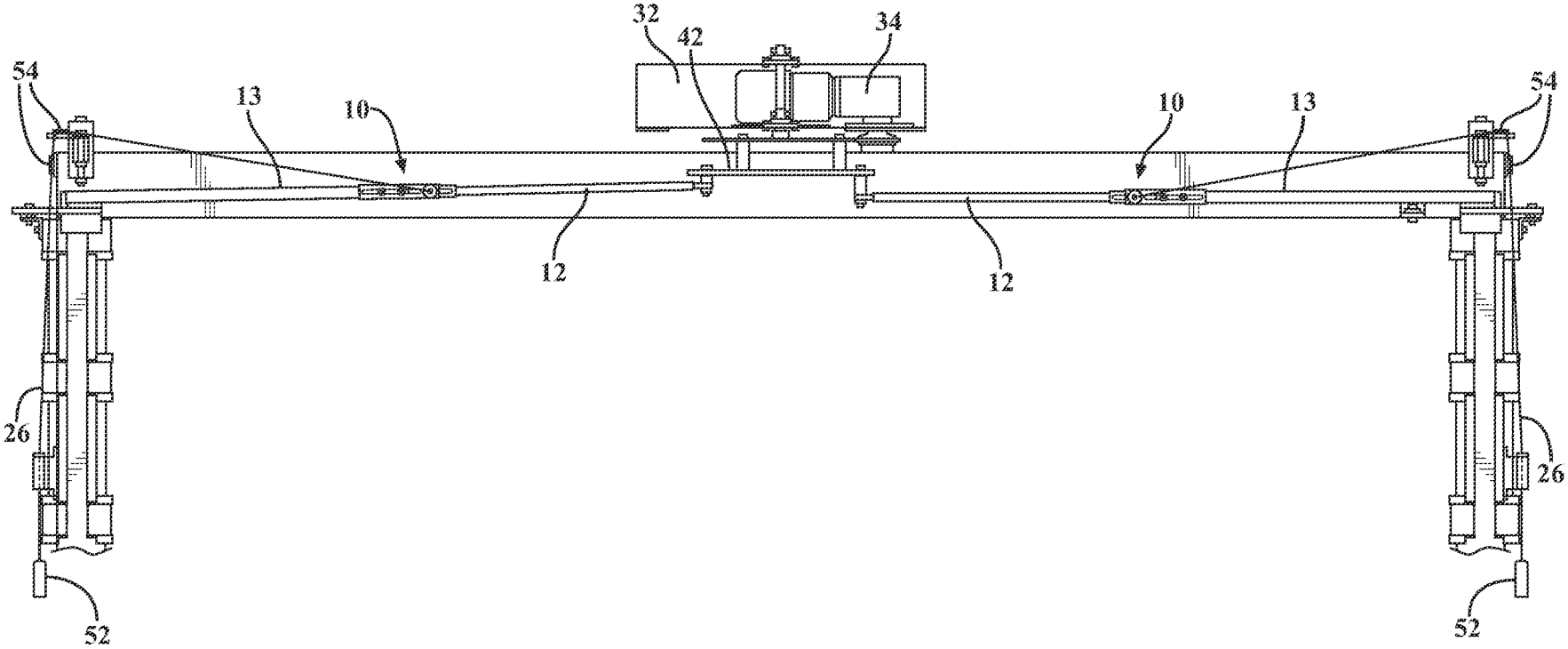

FIGS. 6A and 6B providing further succeeding views with the doors pivoted open during normal operation. This is further depicted by pivoting of the control arm 42, via operation of the overhead motor station and gear/chain linkages, from the closed position shown in FIG. 4. In this condition, the inside hinged interface established between each pair of pivotally associated doors 44/46 and 48/50 results in the telescoping of the push rods 12 relative the operator arms 13 (following the manual retraction of each of the spring pins 16) with the push rod end supporting control arm 42, which is hingedly connected at opposite ends to the push rods as shown in FIGS. 6A and 7A, likewise being rotated.

Figure 7A:
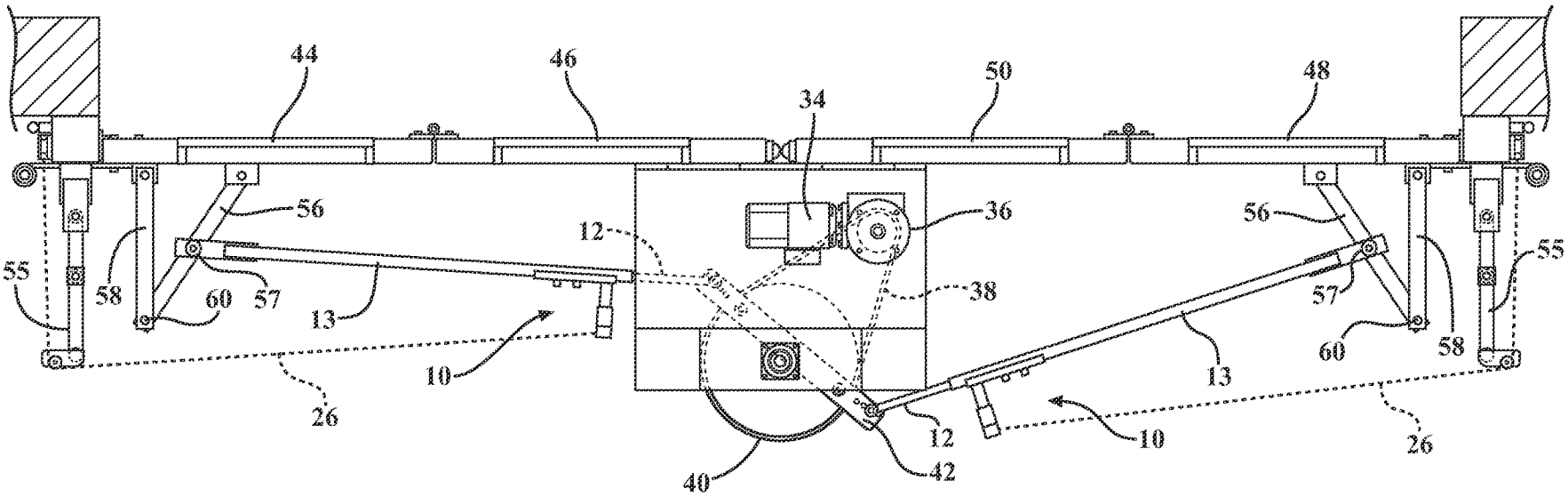
FIGS. 7A and 7B are further succeeding views with the doors pivoted open with the power out, bypass telescoping of the push rod to operator arm linkage in response to deactivation of the power bi-directional central overhead drive unit with electrical motor and linkage operated control arm.
Figure 7B:
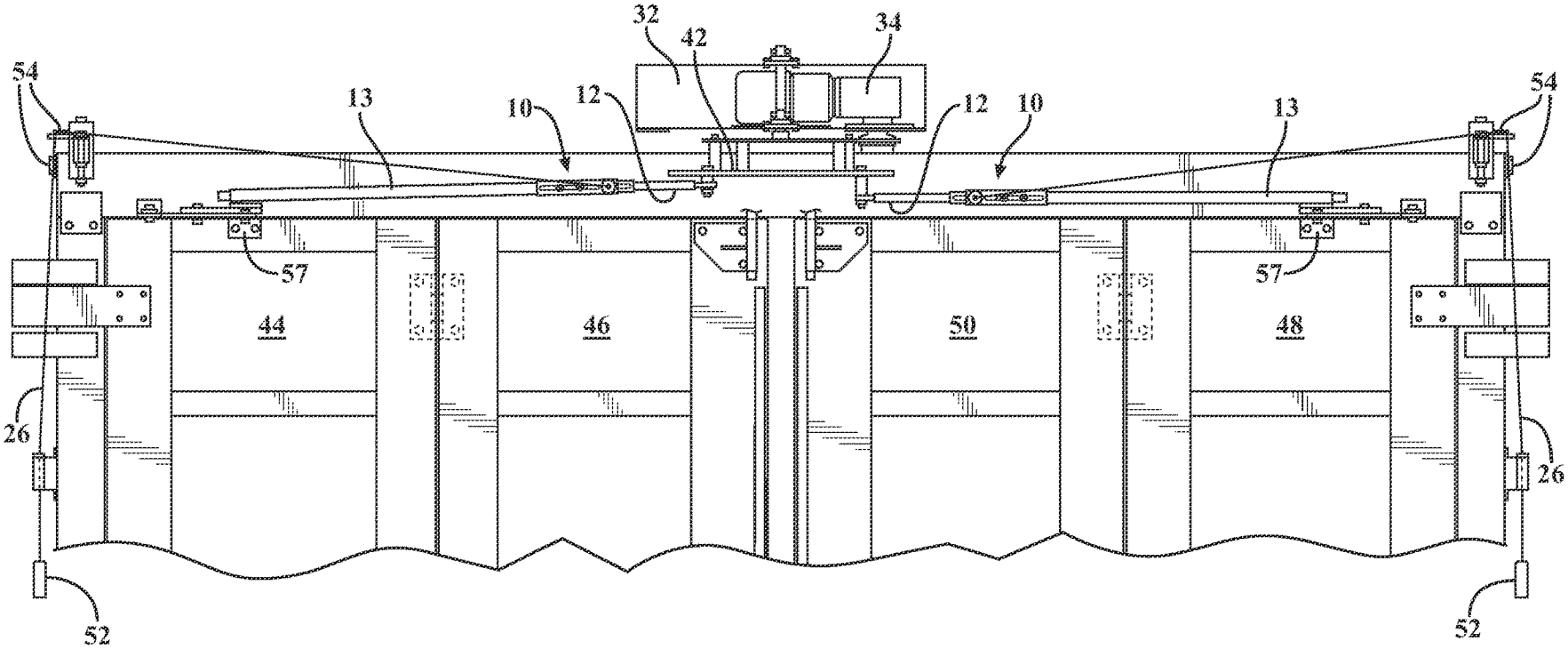

FIGS. 7A and 7B depict upper front and top plan views of the doors open with the power out and the emergency device unlocked for reclosing. The push rods 12 are again depicted in this illustration substantially telescoped into the control arms 13, as compared to FIGS. 6A and 6B.

Figure 8A:
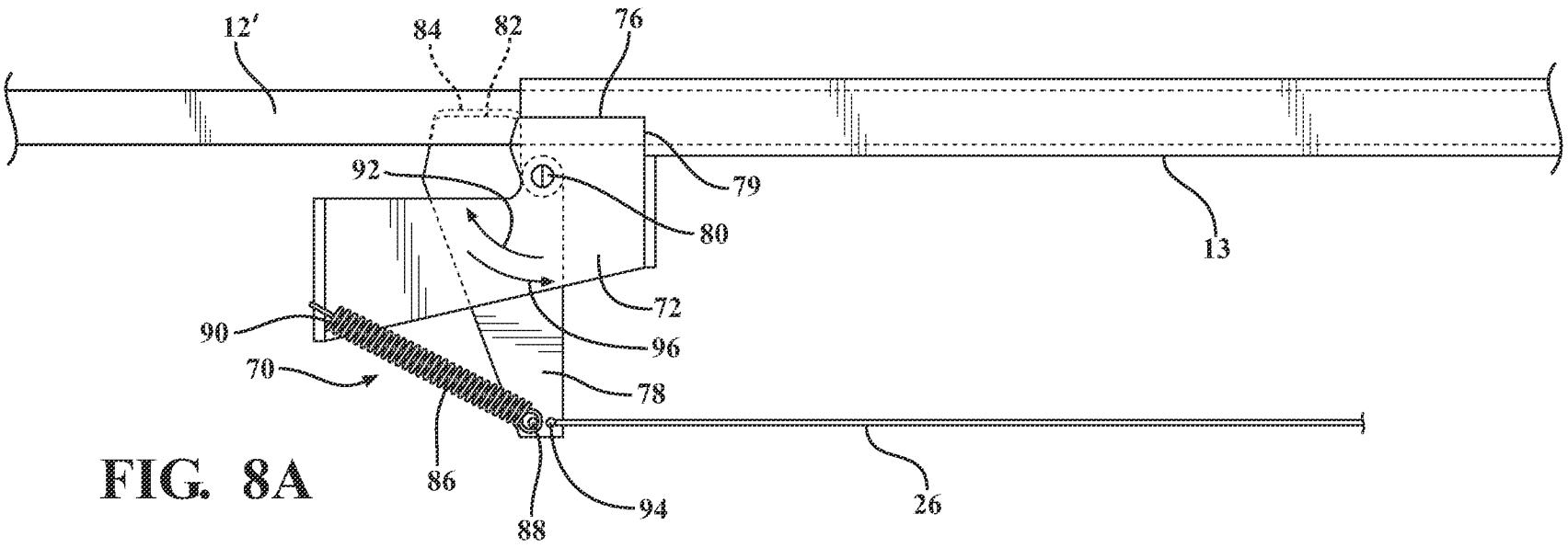
FIGS. 8A and 8B illustrate first and second ninety degree rotated views of a push rod to operator arm interface incorporating a further variant of cable actuated emergency release mechanism according to the present invention.
Figure 8B:
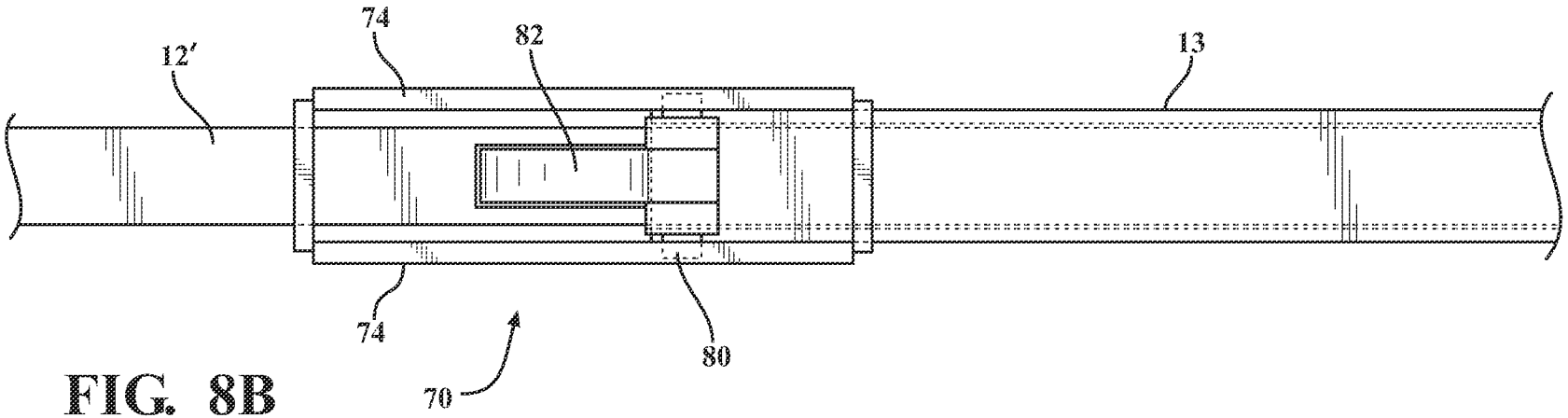

FIGS. 8A and 8B illustrate first and second ninety degree rotated views of a push rod to operator arm interface incorporating a further variant of cable actuated emergency release mechanism, generally at 70, according to the present invention. The emergency release mechanism 70 otherwise substitutes into a four fold power door system similar to that depicted in FIGS. 4-7.

A first substantially "L" shaped and fixed bracket 72 is depicted in top plan view in FIG. 8A and, as additionally depicted in the rotated side view of FIG. 8B, can include a pair of spaced apart brackets 74 which are welded (see at locations 76) along each of first edge interfaces 76 to opposite sides of the operator arm 13. A second substantially flattened and elongated member 78 is pivotally mounted, about pinned location 80, to the fixed bracket 72 (or between the pair of fixed brackets welded to the opposite sides of the operator arm. A first inner end 82 of the elongated pivot member 78 is, in an engaged position, seated within a notch 84 (or other aperture configuration) which is in turn formed in a variation of the push rod, at 12', and at a location proximate to the telescoping interface established between the push rod to operator arm interface.

A coil spring 86 is provided and is connected at a first end 88 to an outer corner location of the pivotal member 78, as well as at a second end 90 to a rear exposed edge location of the fixed bracket 72. In this fashion, the coil spring 86 exerts a clockwise directed force (see arrow 92) on the pivotal member 78 to normally bias the seating inner edge 82 of the pivot member 78 into contact with the notch 84 defined in the push rod 12', thereby preventing manual or bypass telescoping of the push rod relative to the operator arm.

A cable or manual release wire rope, again at 26, is provided extending from the handle release locations (again at 52 in FIGS. 4-7) at ground level, around the upper corner pulleys 54 and to an edge location 94 (FIG. 8A) associated with each pivotal member 78. Upon pulling on the remote handle 52, the pivotal member 78 is counter pivoted in a counter-clockwise direction (see further arrow 96), thereby causing the engagement inner end 82 of the pivotal member to unseat from the notch 84, thereby permitting bypass telescoping of the push rod relative to the operator arm in a similar fashion depicted in the previous embodiment. In this fashion, the linkage controlling each pair of folding doors can be manipulated fully between the closed and opened positions and further such that the doors can be opened and then fully reclosed without power to the assembly.

Having described my invention, other and additional preferred embodiments will become apparent to those skilled in the art to which it pertains, and without deviating from the scope of the appended claims.

The invention claimed is:

1. A manual release assembly for use with a power door system including an overhead linkage assembly for actuating a pair of pivotally connected door panels to pivot in opposite directions between closed and opened positions, the linkage assembly including an operator arm telescopically supporting a push rod, said release assembly comprising:

a housing secured to the operator arm;

a spring biased pin extending through aligning apertures in the operator arm and the push rod;

a compression spring supported within said housing and influencing said spring pin into the aligning apertures of the operator arm and the push rod;

a release cable extending from said housing and, in response to displacement of the cable by an operator, causing said spring pin to retract from the aligning apertures in the operator arm and the push rod, permitting inter-telescoping motion of the push rod relative the operator arm in response to the operator exerting a force upon the door panels thereby permitting manual displacement of the door panels a locking pin and a locking pin guide incorporated into a cable mounting guard positioned in the housing below said spring pin, said locking pin displacing with said spring pin and preventing return displacement of said spring pin into the aligning apertures in the operator arm and the push rod in response to the displacement of the cable by the operator.

2. The assembly as described in claim 1, further comprising a spring retainer for supporting said spring pin.

3. The assembly as described in claim 1, further comprising a manual release handle for displacing the release cable and an arrangement of pulleys routing the cable to the housing.

* * * * *